US006283229B1

(12) United States Patent
Wentworth et al.

(10) Patent No.: US 6,283,229 B1
(45) Date of Patent: Sep. 4, 2001

(54) IMPACT DEVICE FOR DIRECTIONAL BORING

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/024,834

(22) Filed: Feb. 17, 1998

(51) Int. Cl.[7] ..... E21B 4/06

(52) U.S. Cl. ..... 175/62; 175/295; 175/299; 405/184; 173/11; 173/13; 173/152

(58) Field of Search ..... 175/293, 295, 175/299, 19, 62; 405/184; 173/11, 13, 15, 152

(56) References Cited

U.S. PATENT DOCUMENTS

| | | | | |
|---|---|---|---|---|
| Re. 33,793 | | 1/1992 | Cherrington | 175/61 |
| 2,385,439 | * | 9/1945 | Gubbins | 173/13 |
| 3,946,819 | * | 3/1976 | Hipp | 175/296 |
| 4,462,471 | * | 7/1984 | Hipp | 175/296 |
| 4,505,302 | | 3/1985 | Streatfield | 138/97 |
| 4,694,913 | | 9/1987 | McDonald | 175/6 |
| 4,720,211 | | 1/1988 | Streatfield | 405/154 |
| 4,738,565 | | 4/1988 | Streatfield | 405/154 |
| 4,945,999 | | 8/1990 | Malzahn | 175/19 |
| 4,953,638 | | 9/1990 | Dunn | 175/61 |
| 5,010,965 | * | 4/1991 | Schmelzer | 175/19 |
| 5,070,948 | | 12/1991 | Malzahn | 175/19 |
| 5,139,086 | * | 8/1992 | Griffith, Sr. | 166/178 |
| 5,242,026 | | 9/1993 | Deken et al. | 175/62 |
| 5,289,887 | * | 3/1994 | Puttmann | 175/61 |
| 6,035,954 | * | 3/2000 | Hipp | 175/296 |

* cited by examiner

*Primary Examiner*—William Neuder
*Assistant Examiner*—Zakiya Walker
(74) *Attorney, Agent, or Firm*—Philip G. Meyers Intellectual Property Law, P.C.

(57) ABSTRACT

An impact boring tool according to the invention suitable for using with a directional boring machine has a tubular housing and a head mounted at a front end of the housing. The head preferably includes a chisel configured for breaking loose rocks and stones encountered in soil. A striker is disposed within the housing for delivering an impact force to the head, either directly or through one or more intervening parts. A trigger mechanism causes the striker to deliver an impact to the head and chisel only when an external force exerted on the impact tool in its lengthwise direction exceeds a predetermined level. This predetermined level generally coincides with a maximum effective amount of pushing or pulling force for moving the tool through the ground exerted by an external device such as a directional boring machine.

24 Claims, 4 Drawing Sheets

IMPACT DEVICE FOR DIRECTIONAL BORING

TECHNICAL FIELD

This invention relates to directional boring, particularly to an apparatus and method for bursting an existing pipeline or boring a non-linear hole.

BACKGROUND OF THE INVENTION

Directional and non-directional boring apparatus for making holes through soil are well known. A directional borer generally includes a series of drill rods joined end to end to form a drill string. The drill string is pushed or pulled through the soil by means of a powerful hydraulic device such as a hydraulic cylinder. A spade, bit or chisel configured for boring is disposed at the end of the drill string, which may include an ejection nozzle for water to assist in boring. In general, the direction of boring is controlled by selectively rotating a boring head having an angled face. During rotation, the borer continues straight, whereas when pushed without rotation the boring head moves in the favored direction. See Malzahn U.S. Pat. Nos. 4,945,999 and 5,070,948, and Cherrington U.S. Pat. No. 4,697,775 (RE 33,793). The drill string may be pushed and rotated at the same time as described in Dunn U.S. Pat. No. 4,953,633 and Deken et al. U.S. Pat. No. 5,242,026.

In one variation of the traditional boring system, a series of drill string rods is used in combination with a percussion tool mounted at the end of the series of rods. The rods can supply a steady pushing force to the impact tool and the interior of the rods can be used to supply the pneumatic borer with compressed air. See McDonald et al. U.S. Pat. No. 4,694,913. This system has, however, found limited application commercially, perhaps because the drill string tends to buckle when used for pushing if the bore hole is substantially wider than the diameter of the drill string.

A variety of systems are now known for the installation of underground pipes, particularly for the replacement of an existing deteriorated pipe. In one widely practiced method, a pneumatic impact boring tool is sent through the existing pipeline such that the head of the tool, which may be provided with blades that apply intense local pressure to the existing pipe, fractures or splits the existing pipe. See, for example, Streatfield et al. U.S. Pat. Nos. 4,720,211, 4,738,565 and 4,505,302. A replacement pipe, typically made of plastic such as HDPE, can be drawn along behind the boring tool. This process has proven effective commercially because it bursts the old pipe and replaces it with a new pipe at the same time. However, the system relies on a pneumatic impact tool, which in turn requires an air compressor. Exhaust from the impact tool is vented into the interior of the replacement pipe, which is unacceptable for certain types of pipe installations, such as gas and water lines.

Directional borers are less effective for pipe bursting, especially for hard to burst pipes like cast iron, because the steady pushing force of the drill string lacks the impact power of a pneumatic impact boring tool. Thus, in some instances, a directional borer or winch is used to pull a pneumatic impact tool through an existing pipeline in order to burst the existing pipe and pull in the replacement pipe. These alternatives are effective but require considerable equipment and manual labor. A need remains for a boring system that can avoid the need for a pneumatic impact tool and still provide cyclic impacts suitable for pipe bursting operations, rock breaking, and the like.

SUMMARY OF THE INVENTION

An impact boring tool according to the invention has a tubular housing and a head mounted at a front end of the housing. The head preferably includes a chisel configured for breaking loose rocks and stones encountered in soil. A striker is disposed within the housing for delivering an impact force to the head, either directly or through one or more intervening parts. A trigger mechanism causes the striker to deliver an impact to the head and chisel only when an external force exerted on the impact tool in its lengthwise direction exceeds a predetermined level. This predetermined level generally coincides with a maximum effective amount of pushing or pulling force for moving the tool through the ground, which force is exerted by an external device such as a directional boring machine.

According to a preferred form of the invention, the impact tool includes a head mounted for limited longitudinal movement relative to a housing, a chisel shaft connected to the head, and a trigger shaft engaging the chisel shaft. The trigger shaft initially retains a striker in a rearward position against the action of a striker spring. Upon relative movement between the head and the housing, the trigger mechanism activates to release the striker to apply an impact force to the head through the trigger shaft and chisel shaft.

A directional boring apparatus of the invention includes a drill string, a directional boring machine connected to a rear end of the drill string and capable of forcing the drill string through soil, and an impact boring tool as described above connected to a front end of the drill string. The invention further provides a method of directional boring using such a directional boring apparatus including the steps of pushing (or pulling) the impact tool forward through the ground using the directional boring machine, rotating the drill string while pushing or pulling it to move the tool in a substantially straight forward direction, ceasing rotation of the drill string while pushing or pulling to change the direction of travel of the tool, actuating the trigger mechanism when the pushing force exerted by the drill string exceeds the predetermined level, and re-setting the trigger mechanism after actuating it. The latter operating is preferably done by pulling back on the drill string as described hereafter.

Objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION

Figure 1A:
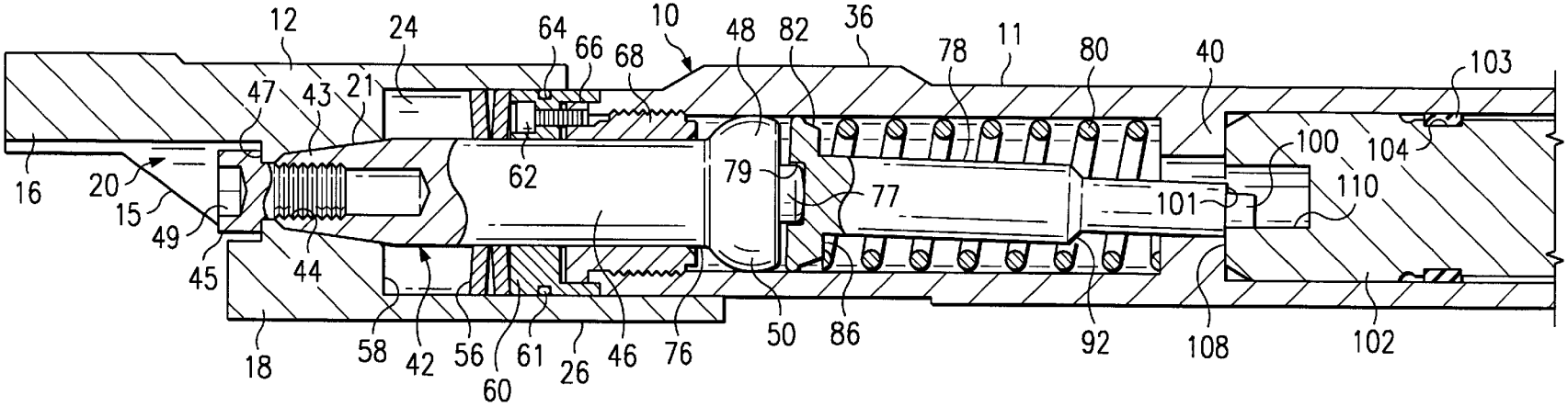
FIG. 1A is a cross-sectional view of a front portion of an impact tool according to the invention.
Figure 1B:
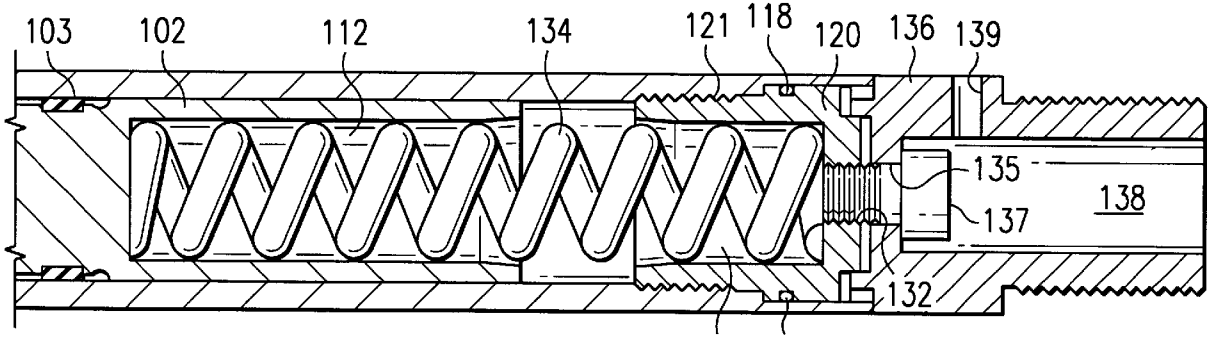
FIG. 1B is a cross-sectional view of the rear portion of the impact tool according to the invention shown in FIG. 1A.
Figure 2:
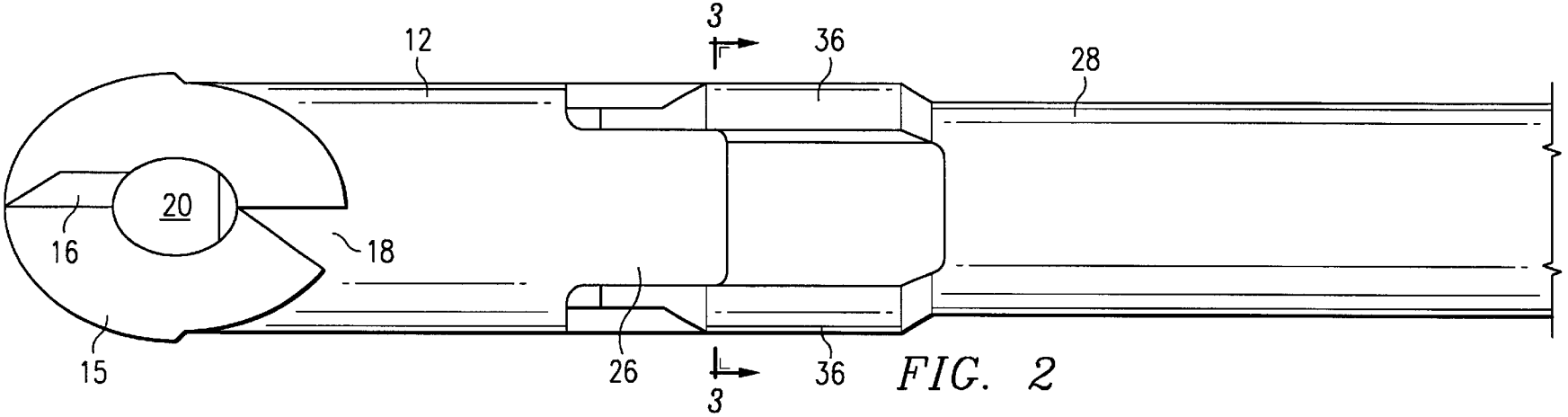
FIG. 2 is a bottom view of the impact tool of FIGS. 1A and 1B.
Figure 5:
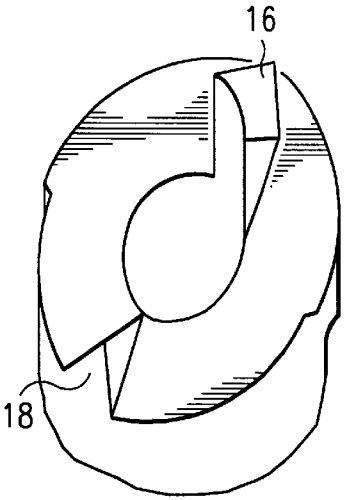
FIG. 5 is a perspective view of the head of the impact tool of FIGS. 1A and 1B.
Figure 4:
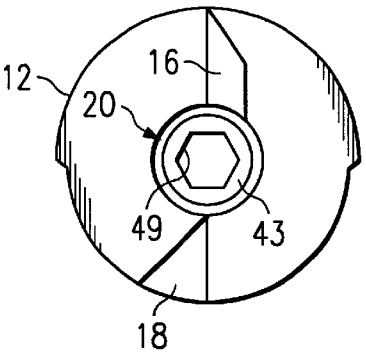
FIG. 4 is a front of the impact tool of FIGS. 1A and 1B.
Figure 3:
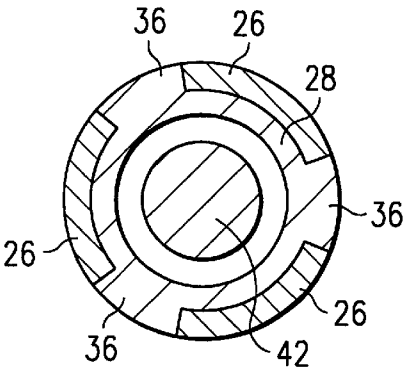
FIG. 3 is a cross-sectional view along the line 3—3 in FIG. 2.

Referring to FIGS. 1A and 1B, an impact boring tool 10 according to the invention is designed to use a combination of axially applied constant force and sudden impact force to penetrate of the earth or crack an existing pipe. Tool 10 includes a head 12 mounted at the forward end of a tubular body or housing 28, a tail nut 120 disposed in a rear end opening of body 28, and an end cap 136 which serves to connect the tool to a string of rods as described hereafter.

Head 12 has an oblique front surface 15 which is provided with forwardly-facing knife edges 16 and 18. An axial fastener-receiving hole 20 extends into head 12 from the forward end thereof. A rear portion of head 12 has a plurality of circumferentially spaced, longitudinal splines 26. A front portion 30 of tool body 28 has a plurality of circumferentially spaced, longitudinal splines 36 which matingly receive splines 26 of head 12. In this manner, head 12 is slidably supported on body 28 but is prevented from rotating relative thereto.

A cylindrical chisel shaft 42 is axially aligned with the body 28. Chisel shaft 42 is positioned behind head 12, and a frontwardly tapered front end 43 of chisel 42 is seated in a frontwardly tapering rear end portion 21 of hole 20. A central threaded hole 44 at the forward end of chisel shaft 42 threadedly receives the stem of a bolt 45 that is inserted through hole 20 of head 12. As the head of bolt 45 engages an annular, frontwardly facing wall 47 in hole 20, head 12 and chisel shaft 42 become locked together. Bolt 45 is secured and removed by means of a hex-shaped socket 49.

Chisel shaft 42 further comprises an elongated cylindrical midportion 46 which extends rearwardly to an enlarged rounded rear end portion 48. A number of Belleville springs 56 (in one or more pairs) are situated within a rearwardly opening cavity 24 of head 12 and disposed around the tubular midportion 46 of chisel shaft 42. During actuation of tool 10, as described hereafter, Belleville springs 56 are compressed between an annular wall 58 situated at the bottom of cavity 24 and a front end cap 60.

Front end cap 60 is disposed concentrically with tool body 28 in contact with midportion 46 of chisel shaft 42 at a location behind springs 56. Cap 60 has a peripheral annular groove 64 which receives a seal ring 61 therein. Seal ring 61 prevents dirt from entering the inside of the apparatus during sliding movement of head 12 relative to body 28. A plurality of radially spaced, stepped bolt receiving apertures 62 extend through cap 60 in the lengthwise direction of the tool body 28.

An enlarged head portion of a head nut 68 is disposed in a rearwardly opening recess 66 of front end cap 60. A rear threaded portion of head nut 68 is secured in corresponding threads formed on the inside of body 28 near its front end opening. Bolts 69 are inserted into stepped apertures 62 and become seated therein as the threaded end of each bolt 69 engages a frontwardly opening threaded hole 71 in head nut 68. Threaded holes 71 (e.g. six or eight such holes) are ranged in a circular, evenly spaced formation in alignment with apertures 62. As bolts 69 are tightened, front end cap 60 becomes securely clamped to the front end of body 28, and a clamp load is applied to head nut 68. Head nut 68 has a sloped annular rear surface 76 positioned and dimensioned for engagement by a frontwardly tapering stop surface 50 of chisel shaft 42 to limit forward movement of the head-chisel shaft assembly relative to the tool body 28.

A rearwardly extending central boss 77 of chisel shaft 42 has a rounded surface 54 positioned in contact with a circular front end recess 79 in a trigger shaft 78. A trigger coil spring 80 is contained within and co-axial with tool body 28 behind trigger shaft 78. Trigger spring 80 engages a inwardly directed annular flange 40 of tool body 28 and a flange 82 at the front end of trigger shaft 78. This biases trigger shaft 78 toward the front end of the tool 10. Flange 82 has a rearwardly facing surface 86 which engages the trigger shaft spring 80 and which extends at a slight angle (e.g., about 1°–20°) relative to an imaginary annular surface oriented at a 90° angle relative to the lengthwise axis of trigger shaft 78. By this means, in addition to biasing the trigger shaft 78 forwardly relative to housing 28, trigger spring 80 biases the trigger shaft 78 to pivot downwardly as shown in FIG. 1A.

Trigger shaft 78 has a rearwardly tapering shoulder 92 that extends between a relatively large diameter forward portion 96 and a relatively small diameter rearward portion 98. A boss 100 located at the extreme rearward end of trigger shaft 78 forms a step 101 which performs the trigger function as described hereafter.

A cylindrical striker 102 is coaxially disposed inside of tool body 28 rearwardly of flange 40. Striker 102 is supported for sliding movement relative to housing 28 by a series of spaced plastic bearing rings 103 disposed in annular grooves 104. The front end of striker 102 comprises a front, annular trigger shaft engaging surface 108 and a central trigger shaft receiving recess 110. The rear end of striker 102 has a cylindrical spring receiving recess 112.

A tail nut 120 is mounted in a rear opening of body 28 and secured therein by means of internal threads 121 which are engaged by external threads 116. A seal ring 117 is set in an external annular groove 118 rearwardly of threads 116 to prevent contamination of the mechanism in a manner similar to seal ring 61. Tail nut 120 has a forwardly facing, cylindrical spring receiving recess 122. Recess 122 is coaxial with body 28 and also with a smaller diameter threaded aperture 132 which extends rearwardly from recess 122.

A compression spring 134 is contained within recess 112 of striker 102 and recess 122 of tail nut 120. Striker spring 134 is considerably stiffer than trigger spring 80 and biases striker 102 to a forward position as shown in FIGS. 1A, 1B. An end cap 136 is positioned at the extreme rear end of the directional boring tool 10 and is retained by a bolt 137 inserted through a central opening 135 in end cap 136 and secured in threaded aperture 132.

Figure 9:
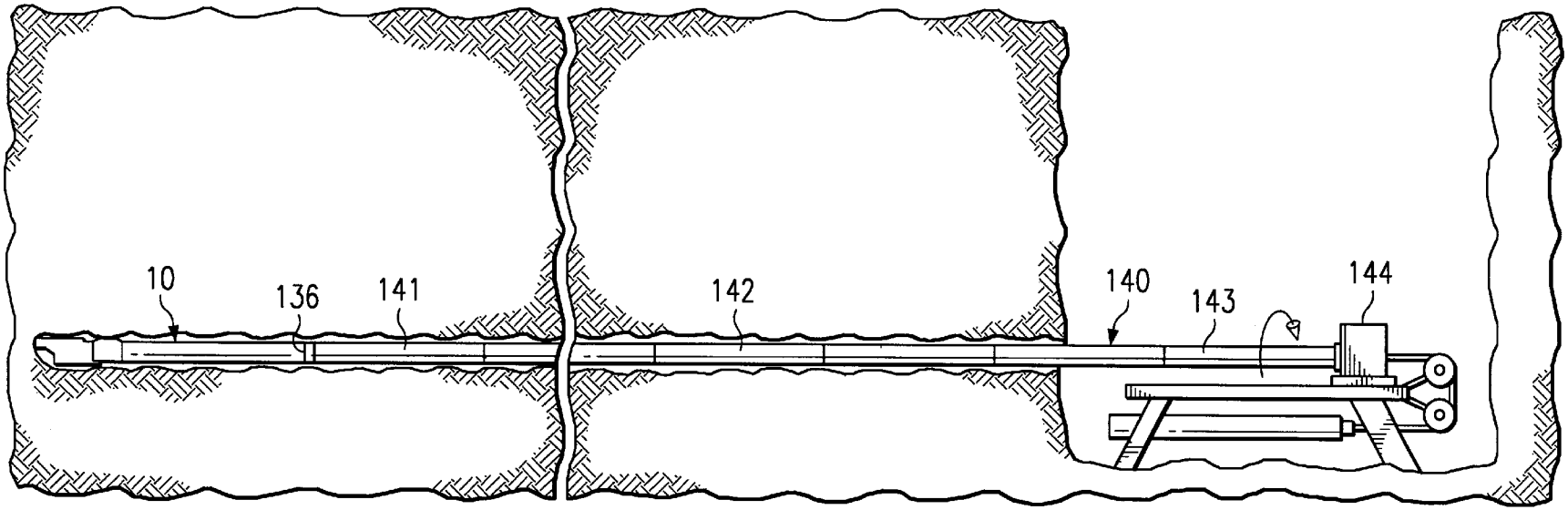
FIG. 9 is a schematic diagram of a directional boring system according to the invention.

FIG. 9 illustrates a directional boring apparatus 140 according to the invention. End cap 136 of tool 10 is adapted to be secured to a front rod 141 of a string of rods 142 which extends from and is actuated by a directional boring machine 143. The string of rods 142 is most commonly pushed into the ground or an existing pipeline by a hydraulic cylinder 144.

In addition to pipe bursting, the present invention is also useful for creating new bores or widening existing bores in which no existing pipeline is present. Drilling mud or pressurized water may be injected through the interior of rods 140 to a rearwardly opening cylindrical recess 138 in end cap 136. One or more radial holes 139 may be provided in end cap 136 so that the lubricating mud can be conducted to the outside of the tool body where it can flow along the tool body, a portion of the mud reaching head 12. More advantageously, means can be provided for conducting the mud directly to head 12 so that more effective lubrication can be achieved with less wasted mud. For example, a channel (not shown) for conducting mud towards head 12 from hole 139 can be provided on the outside of tool body 28. A battery-powered sonde (not shown) may be installed in an additional tubular housing attached to the rear of tool 10. The sonde transmits a radio signal on depth and angular orientation in two axes in a manner known in the art to assist in guiding the tool through the ground.

The illustrated tool 10 is designed for use with a directional boring machine that rotates and pulls or pushes the tool at the same time. The slanted surface 15 of head 12 causes the tool to deviate from a straight path when the tool is pushed but not rotated by the directional boring machine. When the boring machine both rotates and pushes, the tool moves in an approximate straight line because the angled face of the head spends essentially equal time facing each direction.

A known method of directional boring takes advantage of the foregoing to complete a bore beneath an obstruction such as a roadway or stream without having to dig entry and exit pits. The bore comprises three segments or stages. In the first stage, the borer head is directed down into the earth at an angle, often in a curved path. The rods of the drill string bend sufficiently to accommodate the changes in direction. At the second stage, the directional borer must round a corner in order to stop descending and move in a horizontal path beneath the obstruction. In the third stage, the borer must change directions a second time to assume an upward angle, so that the head eventually re-emerges from the ground on the other side of the obstruction.

The most difficult stage of this operation is the second change of direction. The effective pushing force of the directional boring machine becomes progressively less as the drill string becomes longer, and extra force is required to turn a corner even with a relatively small change in direction such as 20–50° from the horizontal. The borer most often becomes stuck at the second corner and must then be withdrawn. The problem is compounded if rocky soil or other hard obstacles are encountered far down the bore.

The present invention addresses the foregoing problem by providing a device which can crack through hard obstacles (e.g., stone, rocks, concrete) using a percussion force supplied by the above-described triggered impact mechanism. The invention can also supply the extra force required to turn a difficult corner during a boring run. The peak force supplied when both the impact mechanism and the directional boring machine are acting together is substantially greater than what the directional boring machine can exert alone, and the force exerted by the impact mechanism is substantially independent of how far the tool has traveled from the point of entry (i.e., the length of the drill string extending behind the tool.) The invention is thus useful as a system for assisting a directional boring system in steering especially when 300' or more out and trying to make a turn.

The invention can also be used with a non-rotational pushing system such as the rod pushing machine sold under the trademark "Hydraburst" by Earth Tool Company. In such a case, a symmetrical or non-slanted head could be used. If a slanted head were used, steering would still be possible by alternately pushing and then manually rotating the series of rods.

Figure 6:
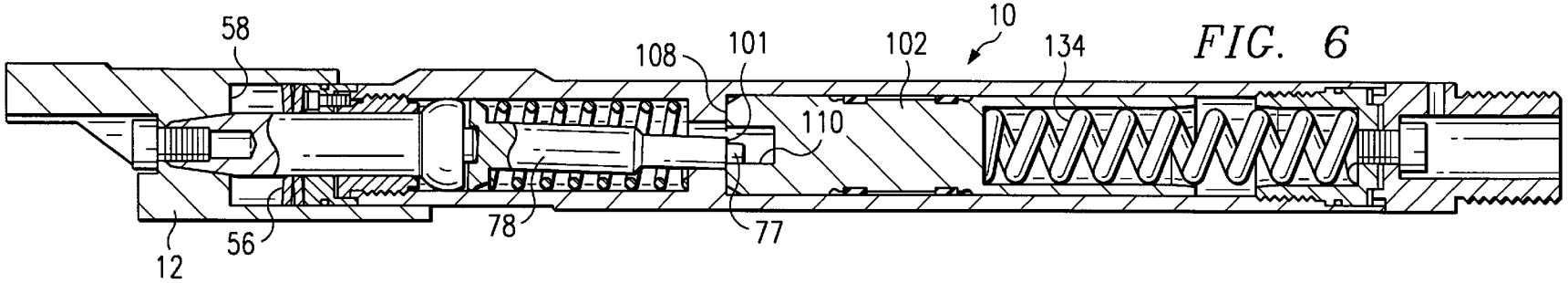
FIGS. 6, 7 and 8 are partial cross-sectional views showing the impact mechanism at various positions during operation.
Figure 7:
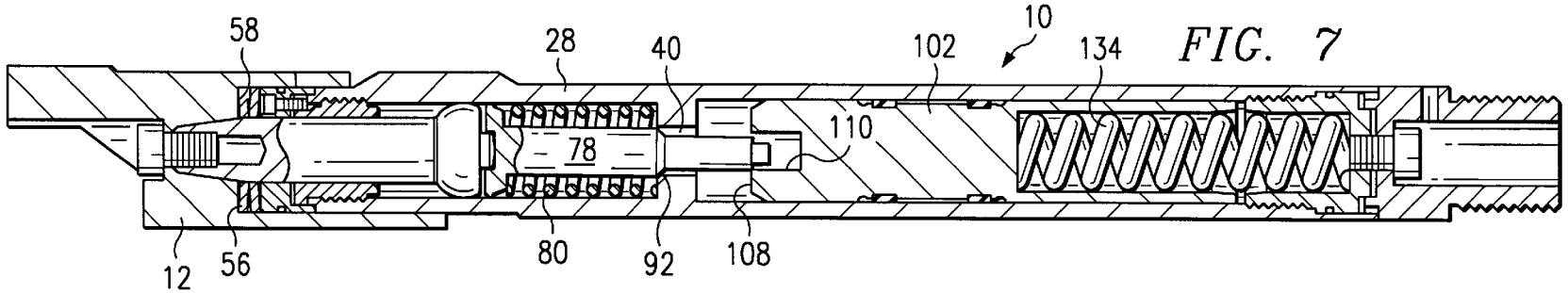
Figure 8:
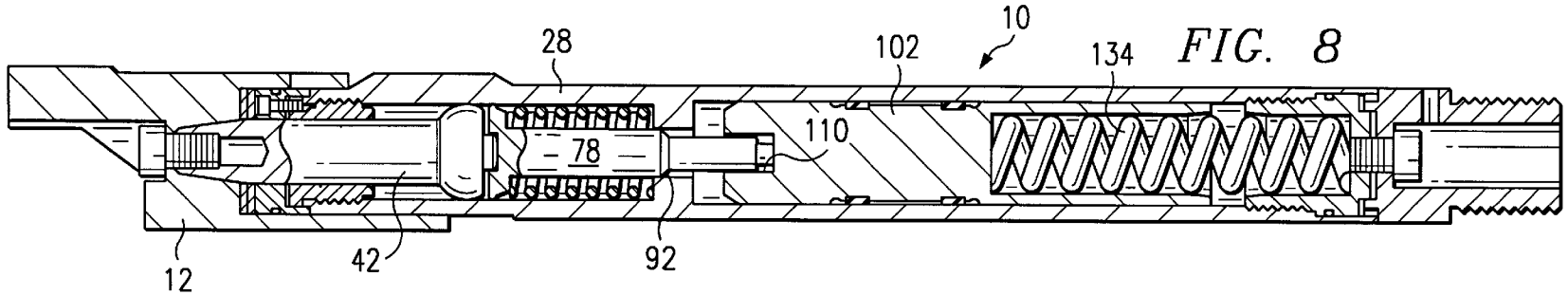

The operation of the directional boring tool 10 is illustrated in FIGS. 6, 7 and 8. FIG. 6 (and FIGS. 1A, 1B)illustrate the directional boring tool 10 in an unloaded condition. A considerable gap may exist between Belleville springs 56 and front wall 58. The rear boss 77 of trigger shaft 78 engages the front recess 110 of striker 102, and the striker spring 134 is relatively uncompressed. The step 101 of trigger shaft 78 engages striker surface 108 at one edge as shown.

When tool 10 is under moderate load, the gap between Belleville springs 56 and wall 58 closes. Engagement between flange 40 of housing 28 and the sloped shoulder 92 of trigger shaft 78 pivots trigger shaft 78 upwardly against the action of the trigger spring 80. However, the rear end of the trigger shaft 78 remains in engagement with the trigger shaft engaging surface 108 of striker 102. The striker spring 134 becomes substantially compressed.

FIG. 7 illustrates the component parts of directional boring tool 10 just prior to actuation of the striker 102 to apply an impact force to head 12. At this point, interaction between flange 40 and shoulder 92 pivots the trigger shaft upwardly until it is almost but not quite aligned with the trigger shaft receiving recess 110 of the striker 102. The striker spring 134 is further compressed.

Upon the next incremental amount of forward movement of the housing 28 relative to the head 12 under the action of the drill string and the directional boring machine, further movement along the sloped shoulder 92 of the trigger shaft 78 moves step 101 off of surface 108 and brings trigger shaft 78 into alignment with recess 110 of the striker 102. Striker 102 immediately moves forward under the action of the striker spring 134. As trigger shaft 78 enters the trigger shaft receiving recess 110, the striker 102 engages the trigger shaft 78, applying an impact force to the head 12 through the trigger shaft 78 and the chisel shaft 42. At this point, the component parts of the directional boring tool 10 are positioned as shown in FIG. 8. Tool 10 is then reset by rearward movement of the drill string under the action of the directional boring machine. This returns the component parts of the directional boring tool 10 to the configuration illustrated in FIG. 6. The operation of the trigger mechanism is comparable to that of a hand-operated machinists' center punch.

In the overall operation of the directional boring tool 10, the directional boring machine operates through a drill string to push the directional boring tool 10 through the earth. When the head 12 engages an obstruction for which the maximum force exerted by the drill string is insufficient to push past, forward movement of the head of the tool stops. Adjustment of the various springs included in the apparatus determines the threshold at which the impact mechanism will be triggered. In particular, Belleville springs 56 are provided in order to reduce the load required to trigger the impact mechanism relative to the total load placed on the tool 10. For example, the maximum force exerted by the directional boring machine may be in the range from 4,000–5,000 pounds, but such a load would put excessive stress on the trigger mechanism and cause it to fail or shorten its life. In the illustrated embodiment, Belleville springs 56 reduce the effective force exerted on the trigger mechanism by as much as 3,000 pounds. Accordingly, the trigger mechanism can be designed to fire under a load of only 2,000 pounds, which corresponds to a load of 5,000 pounds on the tool head and body as exerted by the drill string.

The directional boring machine continues to apply force to tool 10 through the drill string, collapsing the front and rear sections of the tool body and causing splines 26, 36 to move together. As the applied force continues to increase, the component parts of tool 10 move from the configuration of FIG. 6 to the configuration of FIG. 7 and ultimately to the configuration of FIG. 8. At this point, the trigger shaft 78 enters the trigger shaft receiving cavity 110 of the striker 102, which allows the striker 102 to move forwardly under the action of the striker spring 134. The striker 102 thus applies an impact force to the trigger shaft 78 which in turn applies the impact force to the chisel shaft 42 and hence to the head 12, thereby destroying the obstruction. A series of blows can be imparted as needed. Once the obstruction has been demolished, the peak pushing force load no longer reaches the predetermined maximum, e.g., 4,000–5,000 pounds, and the tool continues to operate in the manner of a normal directional borer.

Striker 102 expends most or all of its impact force on the trigger shaft, and the impact is transmitted to the head of the tool as described above. Some remaining portion of the striker's energy may be expended as it impacts against flange 40. However, the force of impact against flange 40 should be sufficiently low as not to damage the drill string. In the alternative, tool 10 can be configured so that striker 102 stops short of flange 40 during its impact stroke.

Although preferred embodiments of the directional boring tool 10 are illustrated in the drawings and described hereinabove, various modifications of the directional boring tool can be made within the spirit and scope of the invention. For example, the chisel shaft and the trigger shaft can comprise a single shaft which both secures the head for limited longitudinal reciprocation relative to the housing while allowing limited pivotal movement of the shaft to effect operation of the device. Also, the longitudinally offset surfaces comprising the trigger shaft engaging surface and the bottom of the trigger shaft receiving cavity can be located on the trigger shaft instead of on the striker, if desired.

Those skilled in the art will appreciate that although particular embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the scope of the invention as expressed in the appended claims.

What is claimed is:

1. An impact boring tool, comprising:

a tubular housing;

a head mounted at a front end of the housing, the head including a chisel;

a striker disposed within the housing for delivering an impact force to the head; and a trigger mechanism which causes the striker to deliver an impact to the chisel only when an external pushing force exerted on the impact tool in its lengthwise direction exceeds a predetermined level; and a coupling at a rear end of the housing for attaching a drill string to the tool, which drill string is capable of exerting a lengthwise pushing force on the tool, wherein the head is mounted for sliding, lengthwise movement relative to the housing, such that shortening of the tool occurs as the external force exerted on the impact tool in its lengthwise direction becomes greater, and the trigger mechanism includes a spring which biases the head and housing such that the spring is compressed as the tool shortens.

2. The tool of claim 1, wherein the predetermined level is a level at which the external force is insufficient to move the tool past an obstacle in the soil.

3. The tool of claim 1, wherein the coupling for attaching the drill string is a threaded surface.

4. The tool of claim 1, further comprising a device that reduces loading on the trigger mechanism to a fraction of the external force exerted on the impact tool in its lengthwise direction, so that the amount of force needed to trigger an impact by the striker using the trigger mechanism is less than the external force exerted on the impact tool.

5. The tool of claim 1, wherein the chisel is configured for breaking loose rocks and stones encountered in soil.

6. The tool of claim 5, wherein the chisel has one or more forwardly extending cutting blades.

7. The tool of claim 1, wherein the chisel has a slanted surface that causes the tool to deviate from a straight path when pushed by the drill string without rotation of the drill string.

8. The tool of claim 1, wherein the trigger mechanism includes a head nut mounted in a front end opening of the housing, and a chisel shaft slidably mounted in the head nut, wherein the chisel is secured to the chisel shaft.

9. A directional boring apparatus, comprising:

a drill string;

a directional boring machine connected to a rear end of the drill string and capable of forcing the drill string through soil;

an impact boring tool connected to a front end of the drill string, which tool includes a tubular housing, a head mounted at a front end of the housing for sliding, lengthwise movement relative to the housing, such that shortening of the tool occurs as external force on the impact tool in its lengthwise direction becomes greater, the head including a chisel configured for breaking loose rocks and stones encountered in soil, the chisel having a sloped surface that can cause the impact tool to change its boring direction when pushed forward by the drill string without rotation of the drill string, a striker disposed within the housing for delivering an impact force to the head, and a trigger mechanism which causes the striker to deliver an impact to the chisel only when an external force exerted on the impact tool in its lengthwise direction exceeds a predetermined level, wherein the predetermined level is the maximum amount of force capable of being applied by the direction boring machine and is insufficient to move the tool past an obstacle, such that the apparatus can bore through the ground with the impact tool inoperative when the external force exerted on the impact tool in its lengthwise direction fails to exceed the predetermined level; and the trigger mechanism including a spring which biases the head and housing apart such that the spring is compressed as the tool shortens, and the trigger mechanism resets when the tool is lengthened back to a starting position.

10. The apparatus tool of claim 9, further comprising a coupling at a rear end of the housing for attaching the drill string to the tool.

11. The apparatus tool of claim 9, further comprising a device that reduces loading on the trigger mechanism to a fraction of the external force exerted on the impact tool in its lengthwise direction, so that the amount of force needed to trigger an impact by the striker using the trigger mechanism is less than the external force exerted on the impact tool.

12. The apparatus of claim 9, wherein the predetermined level is in the range of 4000 to 5000 inch-pounds.

13. A method of directional boring using a directional boring apparatus including a drill string, a directional boring machine connected to a rear end of the drill string and capable of forcing the drill string through soil, and an impact tool connected to a front end of the drill string, which tool includes a tubular housing, a head mounted at a front end of the housing for sliding, lengthwise movement relative to the housing, such that shortening of the tool occurs as external force on the impact tool in its lengthwise direction becomes greater, the head including a chisel configured for breaking loose rocks and stones encountered in soil, a striker disposed within the housing for delivering an impact force to the head, and a trigger mechanism which causes the striker to deliver an impact to the chisel only when an external force exerted on the impact tool in its lengthwise direction exceeds a predetermined level, the trigger mechanism including a spring with biases the head and housing apart such that the spring is compressed as the tool shortens, and the trigger mechanism resets when the tool is lengthened back to a starting position, comprising the steps of:

pushing the impact tool forward through the ground using the directional boring machine;

rotating the drill string while pushing it to move the tool in a substantially straight forward direction;

ceasing rotation of the drill string while pushing to change the direction of travel of the tool;

actuating the trigger mechanism by causing pushing force exerted by the drill string to exceed a predetermined level, wherein the predetermined level is a level at which the external force is insufficient to move the tool past an obstacle, such that the apparatus can bore through the ground with the impact tool inoperative when the external force exerted on the impact tool in its lengthwise direction fails to exceed the predetermined level; and pulling back on the drill string to re-set the trigger mechanism after actuating it.

14. A directional boring apparatus, comprising:

a drill string;

a directional boring machine connected to a rear end of the drill string and capable of forcing the drill string through soil;

an impact boring tool connected to a front end of the drill string, which tool includes a tubular housing, a head mounted at a front end of the housing, the head mounted for sliding, lengthwise movement relative to the housing, such that shortening of the tool occurs as the external force exerted on the impact tool in its lengthwise direction becomes greater, and a trigger mechanism including a spring which biases the head and housing such that the spring is compressed as the tool shortens, the head including a chisel configured for breaking loose rocks and stones encountered in soil, a striker disposed within the housing for delivering an impact force to the head, the trigger mechanism causing the striker to deliver an impact to the chisel only when an external force exerted on the impact tool in its lengthwise direction exceeds a predetermined level, wherein the predetermined level is a level at which the external force is insufficient to move the tool past an obstacle, such that the apparatus can bore through the ground with the impact tool inoperative when the external force exerted on the impact tool in its lengthwise direction fails to exceed the predetermined level; and a coupling at a rear end of the housing for attaching the drill string to the tool.

15. An impact boring tool, comprising:

a tubular housing;

a boring head mounted at a front end of the housing;

a striker disposed within an internal chamber of the housing to deliver an impact force to the head by lengthwise movement within the housing;

a first spring confined within the housing such that rearward movement of the striker away from the head compresses the spring; and a trigger mechanism having an engagement surface that engages the striker and holds it in a position in which the first spring is actuated, wherein the trigger mechanism releases the striker to cause it to deliver an impact force to the boring head when an external force exerted on the impact tool in its lengthwise direction exceeds a predetermined level.

16. The tool of claim 15, wherein the boring head includes a shaft disposed within a front end opening of the housing and slidably moveable over a limited range in the lengthwise direction of the tool, wherein the trigger mechanism first compresses the first spring and then releases the striker in response to shortening of the tool that occurs as the shaft of the boring head moves relative to the housing.

17. The tool of claim 16, wherein the boring head includes a chisel mounted at a front end of the shaft.

18. The tool of claim 15, wherein the boring head includes a chisel mounted at a front end thereof.

19. The tool of claim 15, wherein the striker has a frontwardly facing edge that is engaged by the engagement surface of the trigger mechanism, which edge leaves engagement with the engagement surface when the striker is released.

20. The tool of claim 19, wherein:

the striker has a frontwardly opening recess therein, such that the frontwardly facing edge is on a side wall of the recess; and the trigger mechanism further comprises a trigger shaft having a step which provides the engagement surface, means for biasing the trigger shaft towards a position at which the step is in contact with the frontwardly facing edge of the striker, and means for forcing the engagement surface to release the frontwardly facing edge of the striker after the striker has moved rearwardly a predetermined distance.

21. The tool of claim 20, wherein the trigger shaft is disposed in between the shaft of the head and the striker, whereby upon release of the trigger mechanism, the trigger shaft enters the recess in the striker, the striker moves forward, and a bottom wall of the recess delivers an impact to the trigger shaft, which impact is transmitted through the trigger shaft to the head.

22. The tool of claim 20, wherein the means for biasing the trigger shaft comprises a second spring and an angled surface on the trigger shaft, whereby force exerted by the second spring against the angled surface tilts the trigger shaft.

23. The tool of claim 22, wherein the means for forcing the engagement surface to release the frontwardly facing edge of the striker comprises a radially inwardly extending flange of the housing and a tapered shoulder of the trigger shaft, wherein progressive movement of the tapered shoulder against the flange forces the engagement surface to release the frontwardly facing edge of the striker against the force of the biasing means.

24. The tool of claim 23, wherein the means for biasing the trigger shaft comprises a second spring and an angled surface on the trigger shaft, whereby force exerted by the second spring against the angled surface tilts the trigger shaft.

* * * * *